United States Patent [19]

Slaats et al.

[11] Patent Number: 4,621,868

[45] Date of Patent: Nov. 11, 1986

[54] HEIGHT CONTROL MECHANISM

[75] Inventors: Mathew A. Slaats; Patrick E. Strange, both of Jasper, Ind.

[73] Assignee: Kimball International, Inc., Jasper, Ind.

[21] Appl. No.: 773,337

[22] Filed: Sep. 6, 1985

Related U.S. Application Data

[63] Continuation-in-part of Ser. No. 668,307, Nov. 5, 1984.

[51] Int. Cl.[4] ..... A47C 1/02

[52] U.S. Cl. ..... 297/347

[58] Field of Search ..... 251/9, 10; 248/575, 248/404; 297/347, 349, 339, DIG. 3, DIG. 10; 108/147

[56] References Cited

U.S. PATENT DOCUMENTS

| | | | |
|---|---|---|---|
| 1,651,506 | 4/1923 | Berninghaus . | |
| 3,143,332 | 8/1964 | Watlington . | |
| 3,286,970 | 11/1966 | Nolon | 248/404 |
| 3,381,926 | 5/1968 | Fritz et al. . | |
| 3,438,607 | 4/1969 | Williams et al. | 251/9 |
| 3,594,040 | 7/1971 | Monroe . | |
| 3,836,057 | 9/1974 | MacManus | 251/9 X |
| 3,861,740 | 1/1975 | Tajima et al. | 297/195 |
| 4,074,887 | 2/1978 | Hale . | |
| 4,077,601 | 3/1978 | Dick | 251/9 |
| 4,139,175 | 2/1979 | Bauer . | |
| 4,355,783 | 10/1982 | Morin | 251/9 |
| 4,445,671 | 5/1984 | Reuschenbach et al. . | |

FOREIGN PATENT DOCUMENTS

| | | | |
|---|---|---|---|
| 783416 | 4/1968 | Canada . | |
| 1605927 | 8/1978 | Fed. Rep. of Germany | 248/475 |
| 1151262 | 7/1966 | United Kingdom . | |

*Primary Examiner*—James T. McCall

*Attorney, Agent, or Firm*—Jeffers, Irish & Hoffman

[57] ABSTRACT

A control mechanism for a hydraulic lifting assembly for supporting articles of furniture. The hydraulic lifting assembly includes a base, a support column secured to the base, a variable volume chamber, a fixed volume chamber and a control valve mechanism. The fixed and variable volume chambers are interconnected by a flexible conduit. The control valve mechanism includes a cam secured to a rotatable rod which is positioned so that, by rotating the rod, the cam will selectively pinch off the flexible conduit and prevent fluid flow therethrough. A spring is provided for normally urging the cam against the flexible conduit to pinch off the conduit. The control may be located in any convenient location due the flexibility of the conduit.

17 Claims, 7 Drawing Figures

HEIGHT CONTROL MECHANISM

BACKGROUND OF THE INVENTION

This is a continuation in part of application Ser. No. 668,307 filed Nov. 5, 1984 which is incorporated herein by reference.

This invention relates to a hydraulic lifting mechanism for an article of furniture and to a control mechanism therefor. The mechanism is used for raising and lowering a support surface in an article of furniture such as a chair or the like and includes a control mechanism for selectively controlling the raising and lowering of the support surface.

Specifically this invention relates to a control valve mechanism for controlling the flow of hydraulic fluid to raise and lower a support surface such as a chair seat and wherein the control can be located remotely from the hydraulic power unit, is of simple construction, is efficient in operation and economical in design.

In certain articles of furniture, such as chairs, it is desirable to provide a hydraulic mechanism for adjusting the height of a supporting surface such as for example the height of a chair seat, so that a chair occupant can select the height of the seat best suited for him. A number of prior art mechanisms have been provided for this purpose and those mechanisms in general comprise a pair of rigid walled sealed chambers or reservoirs containing hydraulic fluid and communicating with each other by means of a rigid hollow conduit. One of the chambers is expandable so as to have a variable volume. The other chamber has a fixed volume and contains a compressed gas in addition to hydraulic fluid. The hydraulic fluid may be transferred from the pressurized fixed volume chamber to the expandable chamber when a control valve in the rigid hollow conduit is opened. As the fluid volume in the expandable chamber increases, the chair seat will be raised.

One prior art patent showing a hydraulic lifting mechanism such as described hereinabove is U.S. Pat. No. 4,074,887. This patent shows two circumferentially arranged chambers with the outer chamber comprising a rigid walled sealed chamber containing hydraulic fluid and pressurized gas. An inner chamber is provided comprising a rigid walled expandable chamber including a piston and containing only hydraulic fluid. A control lever is provided for controlling a valve which is located between the chambers to enable hydraulic fluid to be transferred from the outer chamber to the inner chamber. The piston is raised and lowered by operation of the control valve and transfer of the hydraulic fluid between the chambers.

One disadvantage of the prior art structures has been that sliding seals had to be provided to seal the rigid-walled expandable chamber. Such seals are subject to wear and leakage, and as hydraulic fluid leaks out of the mechanism, the volume of hydraulic fluid in the mechanism is reduced thereby adversely affecting the operation of the mechanism. For instance, as hydraulic fluid leaks out, the pressurized gas in the outer chamber will occupy a greater volume, thereby reducing its pressure and causing the upward speed of the chair seat to decrease and the upward force on the chair seat to be reduced, both of which results are undesirable. Furthermore, the lost hydraulic fluid needs to be replaced from time to time so that the mechanism requires servicing. It is therefore desired to provide a pneumatic lifting mechanism wherein no sliding seals are needed and which is not subject to leakage or loss of hydraulic fluid. A further disadvantage of the prior art structures has been that the controls for adjusting the lifting mechanisms have been located adjacent to the mechanisms. Such prior art control arrangements have therefore necessitated that the occupant of the chair had to lean over and reach far under the chair seat to effect control of the mechanism or have necessitated long control mechanisms linkages for operating the control to adjust the chair seat height. It is therefore desired to provide a hydraulic lifting mechanism wherein the control may be located in a convenient location such as in the arm of the chair or adjacent the chair seat whereby the control is easy to operate.

A yet further disadvantage of the prior art structures has been that rather complicated valves have been used to control the transfer of hydraulic fluid between the chambers. Such complicated control valves are relatively expensive and are also subject to failure due to their complexity. It is therefore desired to provide a control mechanism for a hydraulic lifting mechanism for an article of furniture wherein the control valve is simple and inexpensive to manufacture and yet is reliable and efficient. It is particularly desirable to provide a control valve wherein no sliding seals are used.

In some of the prior art lifting mechanisms only a gas rather than an incompressible hydraulic fluid has been used to provide the lifting functions of the mechanism. These types of mechanisms are subject to leakage of gas and therefore result in spongy action of the mechanism since the gas is compressible. It is therefore desired to provide a very positive lifting mechanism, not subject to leakage of the working fluid or having a spongy action and wherein the hydraulic working fluid is incompressible.

In still other prior art mechanisms manual or electric pumps have been provided to transfer the hydraulic fluid to the expanding chamber to cause the lifting action. Such pumps are subject to failure and are also costly. It is therefore desirable to provide a mechanism wherein no pumps are needed to transfer hydraulic fluid between the two chambers and wherein the control of hydraulic fluid flow is effected by a simple but effective valve mechanism.

SUMMARY OF THE INVENTION

The present invention, in one form thereof, overcomes the disadvantages of the above described prior art lifting mechanisms and control assemblies by providing an improved lifting mechanism and control assembly therefor.

The lifting mechanism of the present invention comprises two chambers or reservoirs, one of which is a variable volume reservoir comprising a flexible diagram and containing a hydraulic fluid. The other reservoir has a fixed volume and contains both a hydraulic fluid and a pressurized gas. A flexible conduit interconnects the two reservoirs and includes a control valve assembly for enabling and disabling fluid transfer between the two reservoirs.

More specifically, the present invention, in one form thereof, comprises a base, a support member and a variable volume reservoir including a flexible diaphragm supported by the base and containing a hydraulic liquid. The mechanism further includes a second reservoir which may comprise a rigid walled reservoir containing a hydraulic liquid and a pressurized gas. A flexible conduit interconnects the two reservoirs and includes a control valve assembly for permitting fluid to be transferred between the two reservoirs. The valve assembly includes a lever and a rod secured thereto for rotation upon actuation of the lever. A cam is secured to the rod for rotation with the rod and having at least two positions. In its normal rest position the cam pinches the flexible conduit to prevent fluid flow therethrough. When the lever is actuated the rod and cam will be rotated so that the cam disengages from the flexible conduit thereby enabling fluid flow through the conduit and permitting adjustment of the support member. A spring is also provided for biasing the control valve cam into its normal rest position wherein fluid flow through the conduit is prevented. When the lever is actuated and the valve is opened and when no force acts downwardly on the variable volume reservoir, fluid will be transferred from the fixed volume reservoir to the variable volume reservoir under the action of the pressurized gas in the fixed volume reservoir. As the volume of hydraulic fluid in the variable volume reservoir increases, the fluid volume will occupy more space and the reservoir will expand in the upward direction thereby forcing the support member upwardly.

One advantage of the present invention is that the hydraulic mechanism including the control valve operates without the use of sliding seals, thereby eliminating potential hydraulic fluid leakage, reducing the need for service, and extending the life of the mechanism.

Another advantage of the mechanism of the present invention is that the control may be located remotely from the hydraulic mechanism at any desired location in the article of furniture. Thus, for example, the control valve may be located adjacent the seat of a chair or in the arm of a chair.

Yet another advantage of the mechanism according to the present invention is that the fixed volume reservoir may be located remotely from the hydraulic mechanism thereby permitting the lifting mechanism to occupy very little space in the base of the article of furniture. This permits flexibility in the design of the article of furniture incorporating the lifting mechanism of the instant invention.

A further advantage of the control assembly of the present invention is that the valve mechanism is extremely simple and effective and controls the fluid flow through the flexible conduit with a minimum of wear thereof because the control mechanism is so designed that rubbing action of the flexible conduit is reduced, thereby preventing wearing of the flexible conduit and potential ruptures therein.

A yet further advantage of the present invention is that the control valve is extremely simple and inexpensive and may be used with either a gas or a liquid as the working fluid for the lifting mechanism.

The invention, in one form thereof, comprises a fluid operated height adjustment mechanism for an article of furniture comprising a base, a first fluid filled reservoir and a second fluid filled reservoir. The second reservoir is supported by the base and has a variable volume. A telescoping support member is mounted on the second reservoir and is movable between an extended and retracted position in response to variations in the variable volume. A flexible conduit connects the first reservoir to the second reservoir. A control is provided for selectively controlling the flow of fluid between the first and second reservoirs and includes an actuator for actuating a pivotable closure device for selectively opening the flexible conduit and enabling fluid flow through the conduit.

The invention, in one form thereof, comprises a control valve for a chair height adjustment mechanism including a base and a first hollow member supported on the base. The hollow member contains a hydraulic liquid and includes a flexible diaphragm which forms a wall thereof. A vertically telescoping support member is supported on the first hollow member and in turn supports a chair seat. A second hollow member contains hydraulic liquid and a pressurized gas and is connected to the first hollow member by a flexible conduit. The control valve comprises a rotatable rod and a pinching device secured to the rod for selective rotation with the rod for pinching the flexible conduit to thereby close the conduit and prevent fluid flow therethrough. A lever is provided for selectively rotating the rod.

The invention, in one form thereof, still further provides a control mechanism for a hydraulic lifting assembly for supporting articles of furniture and includes a base, a support column secured to the base and a variable volume chamber comprising a flexible bag and supported by the column. The variable volume chamber contains a hydraulic liquid and supports a support member. A fixed volume chamber contains a liquid and a pressurized gas and is secured to the article of furniture. A flexible conduit interconnects the two chambers for transferring hydraulic fluid therebetween. The control mechanism comprises a cylindrical valve positionable for selectively pinching off the flexible conduit to disable the transfer of hydraulic fluid. The valve is secured to a rotatable actuator for pivoting the valve between its conduit pinching position and a position wherein fluid transfer is enabled. A lever is secured to the actuator for selective rotation thereof. A spring urges the cylindrical valve into its conduit pinching position.

It is an object of the present invention to provide a simple and reliable hydraulic lifting mechanism and control assembly for an article of furniture wherein no sliding seals are used.

It is another object of the present invention to provide a hydraulic lifting mechanism for an article of furniture wherein a flexible diaphragm member is used as one of the reservoirs.

It is still another object of the present invention to provide a hydraulic lifting mechanism for an article of furniture wherein the control may be located remotely from the base of the article of furniture.

A further object of the present invention is to provide a hydraulic mechanism for raising and lowering a chair seat and a control therefor wherein a rigid walled reservoir is located remotely from the hydraulic lifting mechanism.

A still further object of the present invention is to provide a control assembly for a hydraulic lifting mechanism for controlling the hydraulic fluid flow through a flexible conduit wherein a minimum rubbing and wear of the conduit occurs.

A yet further object of the present invention is to provide a control assembly for a hydraulic lifting mechanism which is simple, effective and inexpensive to construct and which may used with either a gas or a liquid as the working fluid.

It is yet another object of the present invention to provide a hydraulic lifting mechanism for a chair wherein no pumps are needed to transfer the hydraulic fluid between the reservoirs.

BRIEF DESCRIPTION OF THE DRAWINGS

The above mentioned and other features and objects of this invention and the manner of obtaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
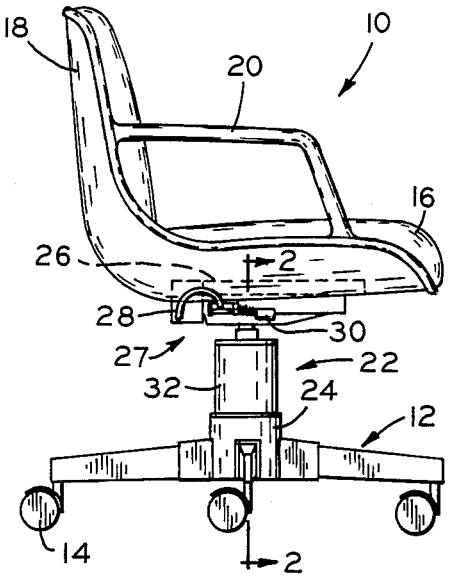
FIG. 1 is a perspective view of a chair incorporating a preferred embodiment of the present invention including a remotely located pressurized reservoir.
Figure 3:
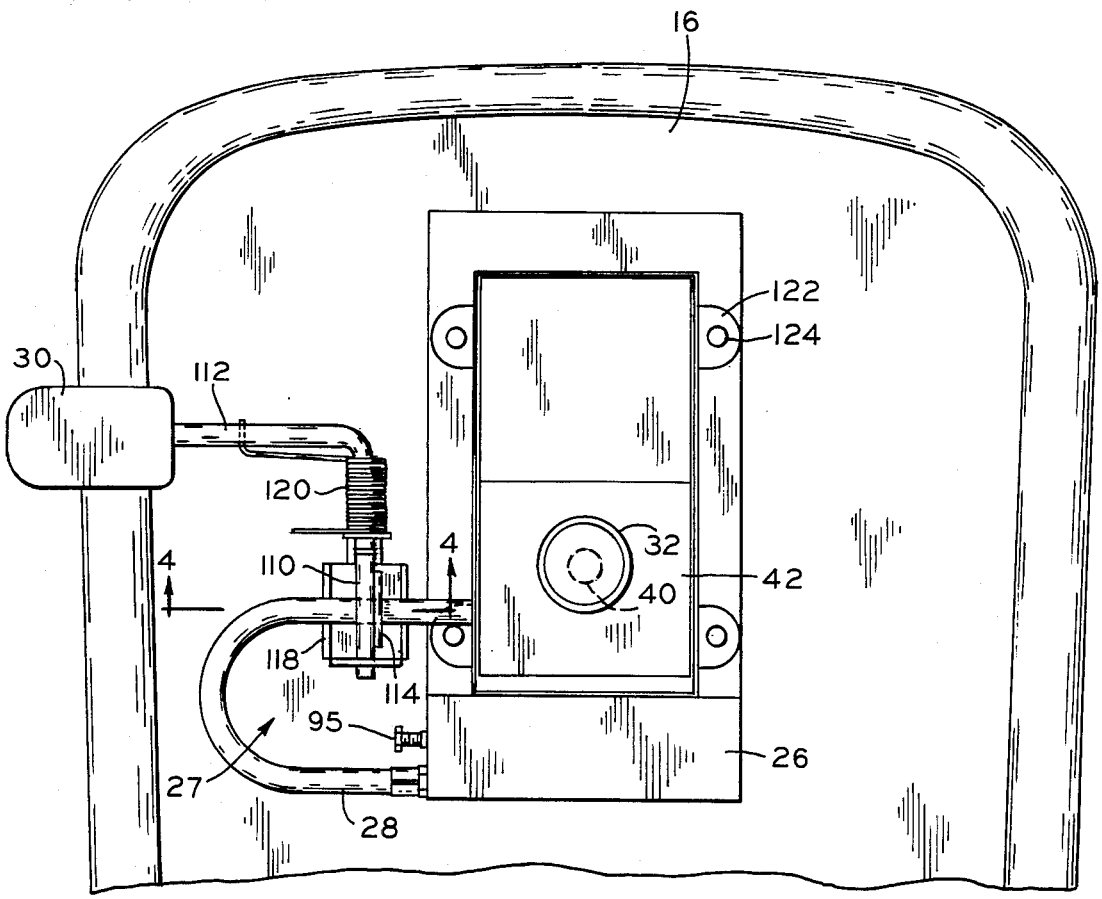
FIG. 3 is an enlarged bottom view of the height control mechanism of FIG. 1.
Figure 5:
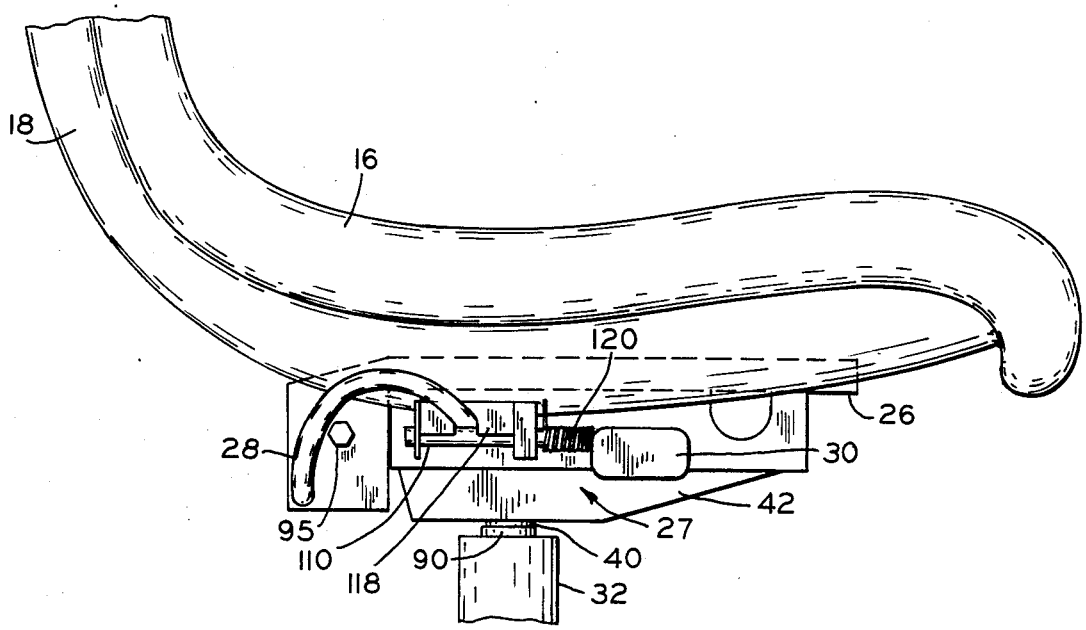
FIG. 5 is an enlarged side view of the control assembly of FIG. 1.

Referring to FIG. 1 a chair assembly 10 is shown comprising a base 12 including casters 14. A chair seat 16 is supported on base 12 and has a back 18 and arms 20 connected thereto. A hydraulic lifting mechanism 22 is shown located intermediate seat 16 and base 12. Mechanism 22 includes lower and upper shrouds 24 and 32 respectively which are preferably cylindrically shaped. A fixed volume reservoir or chamber 26 is secured to seat 16 and a control assembly 27 is provided for controlling the flow of hydraulic fluid between the fixed volume reservoir 26 and a variable volume reservoir located in hydraulic lifting mechanism 22 and further described hereinafter. A flexible conduit 28 is shown for connecting the fixed and variable reservoirs. Control lever 30 is located conveniently close to seat 16 for actuating control valve assembly 27 and for enabling or disabling fluid flow through conduit 28.

Figure 2:
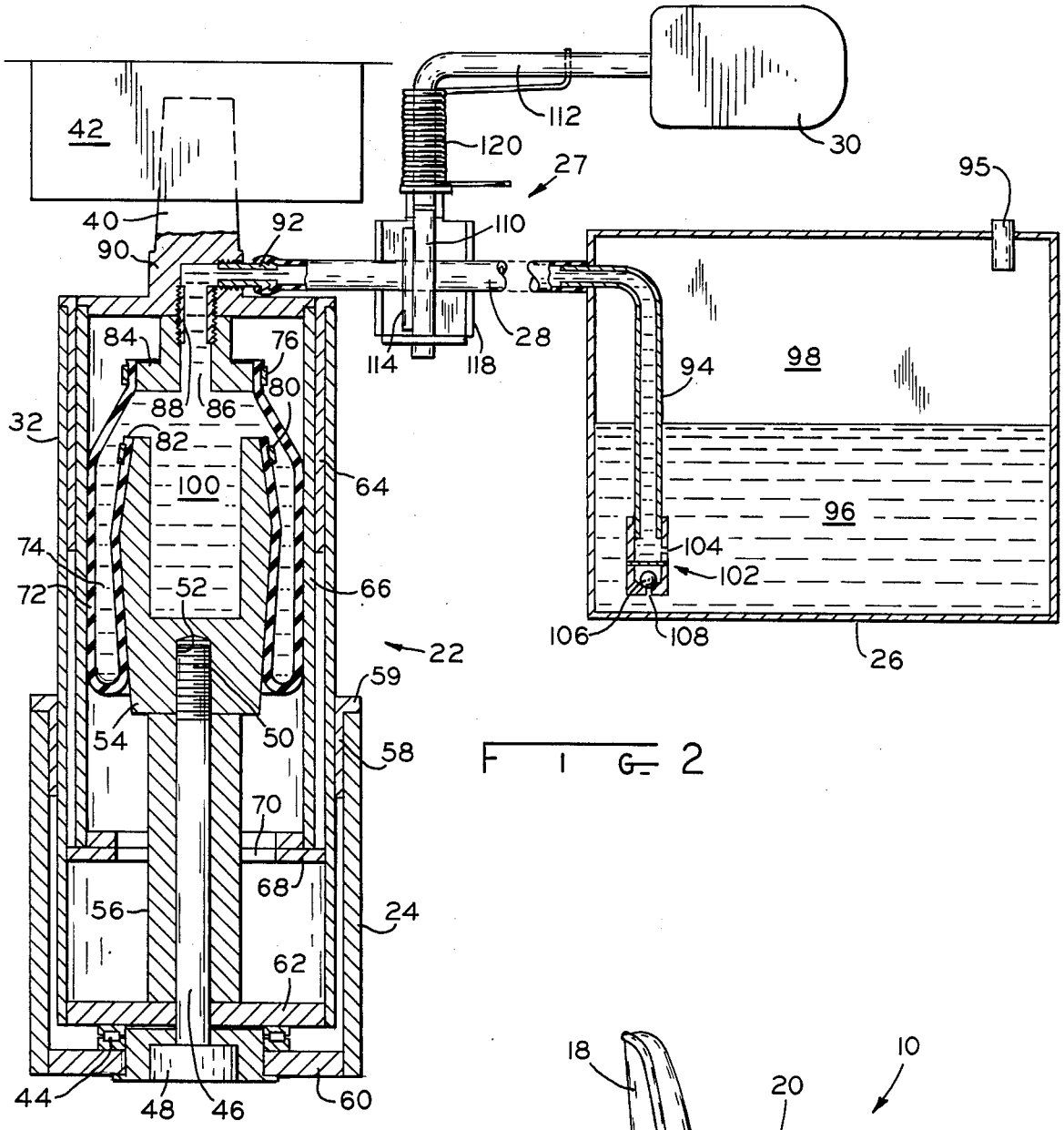
FIG. 2 is a sectional view of the hydraulic lifting mechanism of FIG. 1 taken along line 2—2 of FIG. 1 and showing the remotely located reservoir and the control valve assembly in diagrammatic form.

Referring now to FIG. 2 a preferred embodiment of the invention is shown. A shaft 40 is shown at the upper end of hydraulic lifting mechanism 22 for telescopingly supporting a support platform 42 on which chair seat 16 is mounted. At the lower end of mechanism 22, adjacent base 12, a thrust bearing 44 is located for rotatably supporting lifting mechanism 22 and chair seat 16. Thrust bearing 44 rests on a bottom portion 60 of lower shroud 24. A rotatable shaft or spindle 46 extends upwardly from an enlarged portion 48 thereof which is located in the bottom portion of lower shroud 24. Thus shroud 24 is stationary and spindle 46 is rotatable. A threaded upper portion 50 of spindle 46 is secured in a threaded aperture 52 of support member 54. A sleeve bearing 58 including a flanged portion 59 is positioned between lower shroud 24 and upper shroud 32 to act as a bearing surface therebetween. Upper shroud 32 is therefore rotatable with respect to lower shroud 24. A guide tube 56 extends upwardly from the supporting bottom portion 62 of upper shroud 32 to prevent lateral movement of spindle 46 and to support spindle 46. A telescoping inner tube member 66 including a bottom portion 68 is telescopically slidably received within upper shroud 32. A spacer 64 is inserted between upper shroud 32 and inner tube 66 to serve as a sleeve bearing surface therebetween. Thus, lower shroud 24, bottom portion 60 of lower shroud 24, and the bottom race of bearing 38 are stationary. Upper shroud 32, the top race of bearing 44, spindle 46, guide tube 56, and telescoping tube 66 including bottom portion 68 thereof are rotatably supported by thrust bearing 44. Bottom portion 68 of inner tube 66 includes an aperture 70 therein to provide clearance between support member 54 and bottom portion 68 as bottom portion 68 moves upward or downward.

It should be understood that, while thrust bearing 44 is shown located in the lower portion of the hydraulic lifting mechanism 22, bearing 44 may also be located in an upper portion of mechanism 22. For instance, aperture 52 in support member 54 could be provided with a ball bearing so that spindle 46 would be stationary and support member 54 would be able to rotate with respect to spindle 46.

Continuing further with FIG. 2 a flexible diaphragm or sock 72 is provided in upper shroud 32. Diaphragm 72 is sealingly connected to an upper portion of support member 54 by means of a crimp ring 80 located in an undercut portion 82 of diaphragm 72. Diaphragm 72 therefore comprises a rolling sock or flexible bag and encloses a volume which is variable. As the sides of the sock roll upwardly so that they no longer fold in upon themselves as shown in FIG. 2, the volume 74 of the bag increases. The other end of sock 72 is secured to a plug 84 by means of a crimp ring 76. Thus the entire sock or flexible bag 72 is sealed and hydraulic fluid can enter or leave flexible bag 72 through opening 86 in plug 84. The volume 74 of flexible bag 72 is therefore variable for purposes described hereinafter. The advantage of providing the novel rolling sock 72 is that a variable volume chamber is provided without the need for sliding seals as required by the prior art structures and as described hereinabove.

A threaded fitting 88 is provided for engagement with plug 80. The other end of threaded fitting 88 engages with top support member 90. Top support member 90 also includes a hose fitting 92 for connecting to flexible conduit 28. Thus a fluid flow path is established from variable volume 74 through opening 86 in plug 84, fitting 88, a passage in top support member 90 and hose fitting 92.

Continuing further with FIG. 2 reservoir 26 is shown located remotely from hydraulic lifting mechanism 22. A tube 94 is provided in reservoir 26 including a check valve mechanism 102 located at the bottom portion thereof. Check valve mechanism 102 includes orifices 104 and 108 and a check valve ball 106 whereby the rate of fluid flow in one direction through check valve 102 is much less than the rate of fluid flow in the reverse direction. Reservoir 26 also includes a fill valve fitting 95 for supplying hydraulic fluid to the mechanism. Reservoir 26 contains a hydraulic fluid 96 which is preferably an incompressible liquid 96, and furthermore includes a compressible fluid such as gas 98. The hydraulic fluid used is preferably water mixed with hydraulic oil. Variable volume reservoir or bag 72 includes only incompressible hydraulic liquid 100. Flexible conduit 28, which may constructed of plastic, rubber or the like, connects the two reservoirs to permit hydraulic fluid transfer therebetween. Because tube 94 extends into the bottom of reservoir 26 only hydraulic liquid will be transferred from reservoir 26 through tube 94 and flexible conduit 28 to reservoir 72.

It should be understood that while reservoir 26 is disclosed in the preferred embodiment as having a fixed volume it may also be constructed to have a variable volume. The function of reservoir 26 is to serve as a holding tank for hydraulic working fluid. It should also be noted that by using a suitable length for conduit 28, reservoir 26 may be located in any convenient location in the chair or article of furniture or may be located remotely therefrom. As illustrated in the embodiment of FIG. 1 reservoir 26 is located below chair seat 16. However it should be understood that any convenient location for reservoir 26 may be chosen.

Figure 4:
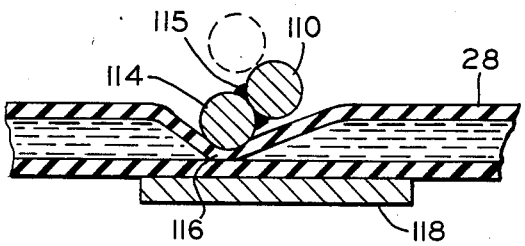
FIG. 4 is a sectional view of the control valve taken along line 4—4 of FIG. 3.

Referring now to FIGS. 2–5 the control valve mechanism 27 is shown in greater detail. The assembly includes a rod member 110 which has a portion 112 thereof bent at right angles to the main portion thereof. A cam member 114 is secured to rod 110 as by welds 115 so that cam 114 will rotate around the axis of rod 110 as lever 30 is operated. While cam 114 is illustrated in the preferred embodiment as a cylindrical rod, cam 114 may have a variety of shapes. Cam 114 operates to pinch flexible conduit 28 at 116 to shut off fluid flow. The portion of cam member 114 which comes in contact with conduit 28 should be rounded and smooth so as to cause a minimum of abrasion and wear of the wall of tube 28 so that tube 28 will not rupture. Rod 110 and cam 114 are rotatably mounted in valve body 118 which also supports tube 28 whereby the tube is pinched at 116 between valve body 118 and cam 114 as shown in FIG. 4. A spring 120 is provided for normally biasing the valve into the closed position wherein cam 114 pinches off tube 28. Brackets 122 are provided on support platform 42 for securing the platform to the chair seat bottom by means of fasteners 124. It should be understood that any convenient location for reservoir 26 may be chosen as the assembly, by use of flexible conduit 28 and valve assembly 27, permits flexibility in the location of reservoir 26.

In operation the mechanism functions as follows. Volume 74 of flexible bag 72 is filled with a volume 100 of hydraulic liquid. Reservoir 26 also contains a volume 96 of hydraulic liquid and furthermore contains a volume 98 of pressurized gas. When the operator pushes down on lever 30 the cam 114 will rotate to that conduit 28 is opened. If seat 16 is not occupied the pressure of gas 98 on incompressible liquid 96 will force hydraulic liquid through orifices 104 and 106 into tube 94 from whence it will pass through conduit 28 and into flexible bag 72. The walls of flexible bag 72 are in contact with the inside surfaces of the walls of tube 66 so that volume 74 can expand only in the upward direction. As a greater volume of hydraulic liquid 100 is forced into volume 74, reservoir 72 will expand upwardly, thereby enlarging volume 74 and pressing on plug 84. Plug 84 forces top support member 90 and shaft 40 upwardly together with support platform 42 and chair seat 16.

When the operator releases lever 30, spring 120 will cause cam 114 to rotate and pinch off conduit 28 thereby closing conduit 28. Since valve 27 is now closed, seat 16 cannot move downwardly because of the incompressibility of hydraulic fluid 100 in bag 72. Bag 72 is constructed to have flexible walls. However the walls stretch only slightly and the material from which diaphragm 72 is constructed must therefore be of sufficient thickness to prevent undue stretching under pressure of the hydraulic liquid in bag 72. The material must be flexible enough to allow the bag to flex and to act as a rolling sock to vary the size of volume 74 contained in bag 72. A preferable material for diaphragm 64 is neoprene rubber since this material is sufficiently flexible and is resistant to oil.

If it is now desired to lower seat 16, a weight is placed on the chair seat such as for instance by means of a person occupying the chair and valve 27 is opened by depression of lever 30. The weight of the chair occupant will cause pressure on the incompressible hydraulic liquid in volume 74, causing it to flow out of reservoir 72 through opening 86 in plug 84 and through conduit 28, valve 27 and orifice 104 into reservoir 26. Hydraulic liquid cannot pass downwardly through orifice 108 since check valve ball 106 will seat on orifice 108 to prevent hydraulic liquid from flowing through orifice 108 into reservoir 26. Orifice 104 is sized so that the rate of flow of hydraulic liquid therethrough is sufficiently slow to allow the downward speed of the chair seat to be comfortable for the chair occupant. This slow downward speed allows the occupant to choose the exact position in which he want to stop the descent of seat 16.

What has therefore been provided is a very simple and efficient mechanism for raising and lowering the chair seat. No sliding seals are used in the construction of the mechanism whereby leakage of hydraulic fluid is eliminated. Furthermore no pumps are needed in order to provide upward movement of the chair seat since the pressurized gas 98 provides the pumping function.

Additionally what has been provided is a very simple control which may be located in any convenient location in the chair including the arm portion of the chair or adjacent the chair seat where it is easily accessible to the chair occupant. To relocate the control all that needs to be done is to use an appropriate length of flexible conduit 28 and to reposition the valve control assembly 27.

While in the disclosed embodiment the hydraulic fluid has been described as a hydraulic liquid, a gas such as Freon or air could be used in the operation of the system. Control valve assembly 27 can be used for the control of the flow of either a liquid or a gas through conduit 28.

It should also be understood that while in the illustrated embodiment the hydraulic lifting mechanism is illustrated in combination with a chair, the mechanism could be used for the support of work surfaces for office furniture such as tables and the like.

Figure 6:
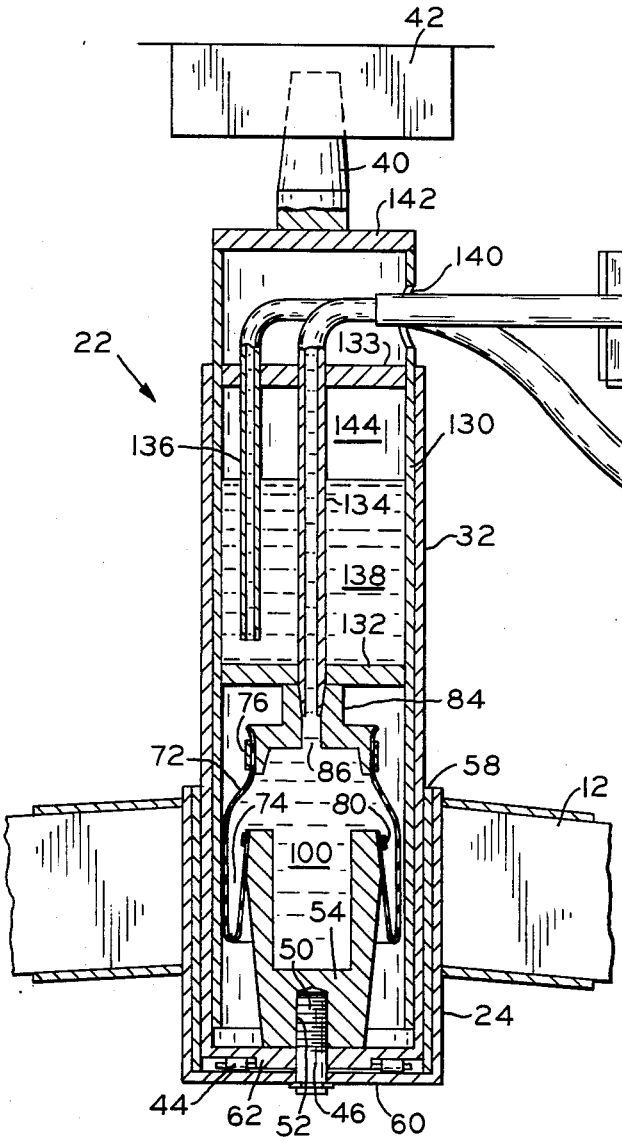
FIG. 6 is a sectional view of an embodiment of the present invention wherein the reservoirs are disposed in stacked relationship.
Figure 7:
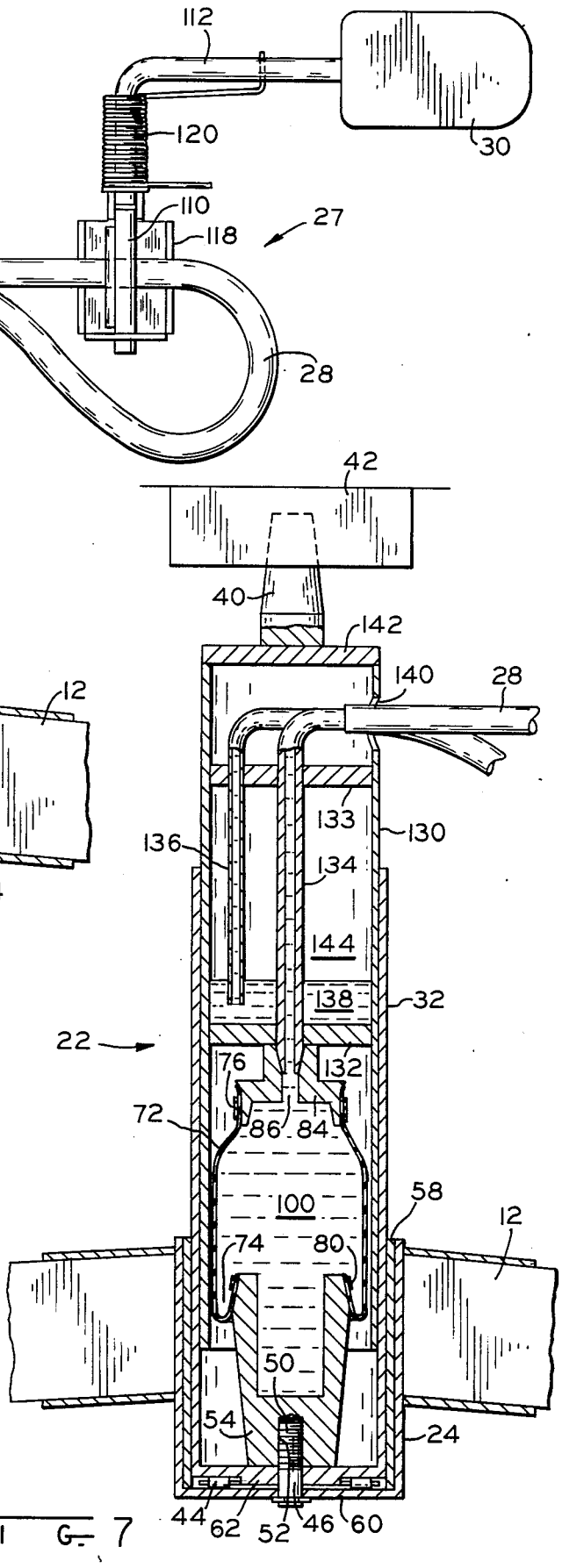
FIG. 7 is a sectional view of the embodiment of FIG. 6 with the variable volume reservoir in the expanded position.

Turning now to FIGS. 6 and 7, an alternative embodiment of the invention is shown. The reservoirs for containing the hydraulic liquid are arranged in stacked relationship rather than remotely from each other as shown in FIG. 1. Thus by reference to FIG. 6 a reservoir 130 is located inside hydraulic lifting assembly 22 above flexible bag 72. Reservoir 130 has an upper wall 133 and a lower wall 132. A conduit or tube 134 connects aperture 86 in plug 84 to flexible conduit 28. Flexible conduit 28 extends through an aperture 140 in an upper extension of the side wall of reservoir 130. A tube 136 connects conduit 28 with volume 138 of hydraulic liquid contained in reservoir 130. An upper support wall 142 is provided to support shaft 40 and support platform 42.

As in the embodiment of FIGS. 1 and 2, lower cylindrical shroud 24 and bottom portion 60 thereof are stationary. Spindle 46 extends upwardly from bottom wall 60. Thrust bearing 44 is supported by bottom wall 60. Upper end 50 of spindle 46 is threadedly received in aperture 52 of support member 54.

In operation as valve assembly 27 is operated by the actuation of lever 30 to enable hydraulic fluid to flow through conduit 28, compressed gas volume 144 in reservoir 130 will force hydraulic liquid through tube 136, conduit 28, tube 134, and opening 86 into expandable volume 74 of flexible bag 72. This causes bag 72 to expand and generates an upward force on plug 84 and bottom wall 132 of reservoir 130. This force is transmitted through the sidewalls of reservoir 130 to top support member 142, whereby shaft 40 and support platform 42 will move upwardly. When an occupant is seated in chair seat 16 and lever 30 is actuated, a downward force on platform 42 and shaft 40 will cause hydraulic liquid to be forced from flexible bag 72 into reservoir 130 thereby allowing the chair seat to descend.

FIG. 6 shows the hydraulic lifting mechanism 22 in its lowermost position. FIG. 7 shows the hydraulic lifting mechanism 22 in an extended or telescoped position wherein support platform 42 is raised. By comparing FIG. 7 with FIG. 6 it can be seen that volume 74 of FIG. 7 is much greater than volume 74 of FIG. 6 and that the bottom portion of flexible bag 72 in FIG. 7 is not folded back upon itself to the same extent as shown in FIG. 6. It can also be seen that upper shroud 32 and reservoir 130 have moved upwardly as a unit under pressure from the hydraulic fluid volume 100 in bag 72 to support shaft 40 and platform 42 in an elevated position. By reference to FIG. 7 it can also be seen that flexible conduit 28 has moved upwardly together with the remainder of the working parts of the hydraulic lifting mechanism 22.

The operation of the control mechanism for the embodiment of FIGS. 6 and 7 is the same as for the embodiment shown in FIGS. 1–5. It should be noted that control mechanism 27 may be located at any convenient location in the article of furniture since flexible conduit 28 can be lengthened or shortened as desired.

While this invention has been described as having a preferred design it will be understood that it is capable of further modification. This application therefore is intended to cover any variations, uses, or adaptations of the invention following the general principles thereof and including such departures from the present disclosure has come within known or customary practice in the art to which this invention pertains and fall within the limits of the appended claims.

What is claimed is:

1. A fluid operated height adjustment mechanism for an article of furniture comprising:

a base;

a first reservoir having a pressurized gas therein;

a second reservoir comprising a flexible wall and being filled with a substantially incompressible liquid, the volume of said second reservoir being variable and said second reservoir being supported by said base;

a telescoping support member mounted on said second reservoir and movable between extended and retracted positions in response to variations in said variable volume;

flexible conduit means connecting said first reservoir to said second reservoir to permit liquid flow between said reservoirs; and control means for selectively controlling the flow of fluid between said first and second reservoirs, said control means including actuating means for actuating a pivotable closure means, said closure means normally pinching said conduit closed, said actuating means operable for selectively causing said closure means to open said flexible conduit and enabling liquid flow through said conduit.

2. The chair height adjustment mechanism of claim 1 wherein said pivotable closure means comprises a rod member rotatable about the rod axis, a cam member secured to said rod and rotatable with said rod member about the rod axis whereby said cam member pivots against said flexible conduit to pinch said conduit and prevent fluid flow therethrough.

3. The chair height adjustment mechanism of claim 1 wherein said control means includes spring means for urging said closure means against said flexible conduit to prevent fluid flow therethrough.

4. The chair height adjustment mechanism of claim 1 wherein said closure means comprises rotatable camming means including a camming surface normally engaged with said flexible conduit means for closing said conduit and wherein said actuating means comprises a lever for selectively operating said camming means to disengage from said conduit thereby enabling transfer of fluid between said reservoirs.

5. The chair height adjustment mechanism of claim 4 wherein said camming means is spring biased into said conduit engaging position and whereby said lever is selectively operated against the spring bias force to open said conduit.

6. The chair height control mechanism of claim 2 wherein said cam member is welded to said rod member.

7. The chair height control mechanism of claim 1 wherein said first reservoir comprises both a liquid and a compressed gas, said conduit means connected to permit only liquid to pass between said reservoirs.

8. The chair height control mechanism of claim 1 wherein said first reservoir is positioned remotely from said base and said second reservoir.

9. The chair height adjustment mechanism of claim 1 wherein said article of furniture is a chair and includes a seat, and wherein said actuating means comprises a control lever which is located adjacent said seat.

10. The chair height adjustment mechanism of claim 1 wherein said second reservoir flexible wall comprises a flexible diaphragm member sealingly secured to a closure member, said closure member inclduing a passage therethrough for connecting to one end of said conduit means.

11. A chair comprising: a base; a seat; a height adjustment mechanism including, a first hollow member supported on said base, said hollow member comprising a flexible diaphragm wall member, said first hollow member containing a substantially incompressible hydraulic liquid, a vertically telescoping support member supported on said first hollow member, said chair seat being supported on said support member and vertically movable therewith, a second hollow member containing a substantially incompressible hydraulic liquid and a pressurized gas, said second hollow member connected to said first hollow member by a flexible conduit means to permit liquid to pass between said hollow members; and a control valve comprising rotatable rod means, pinching means secured to said rod means for selective rotation with said rod means for pinching said flexible conduit to thereby close said conduit and prevent fluid flow therethrough, and lever means for selectively rotating said rod means.

12. The chair of claim 11 including a spring means for urging said pinching means against said flexible conduit to prevent fluid flow therethrough.

13. The chair of claim 11 wherein said pinching means is welded to said rod means.

14. A control mechanism in combination with a hydraulic lifting assembly for supporting articles of furniture, including base, a support column secured to said base, a variable volume chamber comprising a flexible bag and supported by said column, said variable volume chamber containing a hydraulic liquid, a support member supported by said variable volume chamber, a fixed volume chamber containing a liquid and a pressured gas and secured to said article of furniture, a flexible conduit for connecting said variable and fixed volume chambers and for transferring a substantially incompressible liquid therebetween, said control mechanism comprising:

valve means positionable for selectively pinching off said flexible conduit to disable the transfer of liquid, said valve means secured to a rotatable actuating means for moving said valve means between said conduit pinching position and a position wherein liquid transfer is enabled;

lever means secured to said actuating means for selective rotation thereof; and spring bias means operatively connected to said actuating means for urging said cylindrical valve means into said conduit pinching position.

15. The control mechanism and lifting assembly of claim 14 wherein said rotating actuating means comprises a rod member, said valve means is secured to one end of said rod member, and the other end of said rod member is bent at right angles to said cylindrical valve means secured to said lever means.

16. The control mechanism and lifting assembly of claim 14 wherein said cylindrical valve means is welded to said rotating actuating means.

17. The control mechanism and lifting assembly of claim 14 wherein said article of furniture comprises a chair, said support member comprises a chair seat, and said control lever is located adjacent said seat.

* * * * *